US005615422A

United States Patent [19]

Gravel

[11] Patent Number: 5,615,422

[45] Date of Patent: Apr. 1, 1997

[54] COMPACT BATH-CHAIR SUPPORT

[76] Inventor: Pierre Gravel, 427 Montplaisir, Cap-de-la-Madeleine, Qc, G8T 3A8, Canada

[21] Appl. No.: 449,902

[22] Filed: May 23, 1995

[51] Int. Cl.[6] ..... A47K 3/12

[52] U.S. Cl. ..... 4/579

[58] Field of Search ..... 4/577.1, 578.1, 4/579

[56] References Cited

U.S. PATENT DOCUMENTS

| | | | |
|---|---|---|---|
| 1,805,297 | 5/1931 | Sadusky et al. | 4/579 |
| 2,045,110 | 6/1936 | Spiess . | |
| 2,052,628 | 9/1936 | Higgins | 4/185 |
| 2,131,214 | 9/1938 | Bentz | 4/579 X |
| 2,237,076 | 4/1941 | Kenney et al. | 4/185 |
| 2,648,849 | 8/1953 | Webb et al. | 4/185 |
| 3,022,518 | 2/1962 | Hayden | 4/185 |
| 3,875,597 | 4/1975 | McGaffin et al. | 4/185 |
| 3,968,524 | 7/1976 | Zentman | 4/577.1 |
| 4,168,549 | 9/1979 | Davies | 4/185 |
| 4,253,203 | 3/1981 | Thomas | 4/559 |
| 4,359,791 | 11/1982 | Thomas | 4/546 |
| 4,417,361 | 11/1983 | Smith | 4/577.1 |
| 4,628,550 | 12/1986 | Walton | 4/560 |
| 4,887,323 | 12/1989 | DiVito et al. | 4/577.1 |
| 5,150,482 | 9/1992 | Shapiro | 4/562.1 |
| 5,263,207 | 11/1993 | Gilbert | 4/562.1 |
| 5,287,568 | 2/1994 | Mohrmann | 4/561.1 |

*Primary Examiner*—Charles E. Phillips
*Attorney, Agent, or Firm*—Antoine H. Gauvin

[57] ABSTRACT

This invention relates to a compact bath-chair support comprising a frame having a flat bottom surface for resting on top of a side of a bath. The frame has along a first side, at least one jaw downwardly extending, and fixedly or slidably mounted, onto that frame, above a plane containing the flat bottom surface. At least one downwardly extending jaw is slidably mounted on the side opposite the first side, and above that plane containing the flat bottom surface. A screw or other clamps, is positioned above the plane containing the bottom surface, and connected to the jaws that are slidably mounted, for the jaws of one side to move toward and away from, the jaws on the other side, so as to act as a vise, to securely hold the side of a bath near the top. The frame has above the bottom surface, at least one receptacle for receiving the shaft of a chair. Thus the weights of and on a chair and of that frame, are transferred onto the top of the side of a bath, and the jaws releasably hold the side of a bath near the top in order to maintain the flat bottom surface against that top.

20 Claims, 5 Drawing Sheets

COMPACT BATH-CHAIR SUPPORT

BACKGROUND OF THE INVENTION

1. Field of the Invention

This invention relates to a compact bath-chair support. This invention relates in particular to a frame, preferably a block-support, to be mounted over a side of a bath, and resting on top of said side, that frame or block having means for rotatably mounting a chair thereon.

2. Description of Related Art

As far as Applicant is aware, there is no known simple compact bath-chair support having means for rotatably mounting a chair thereon, and being of a size that may be held in one hand only, and which may be securely held by jaws, unto an upwardly extending side of a bath, and where the weight of a person and of the chair rest onto the top of an upwardly extending side of a bath.

U.S. Pat. No. 3,875,597 dated Apr. 8, 1975, as invented by Mc Gaffin et al. describes a stool, but such a device may not be used by a disabled person who does require at least a chair and its rotation.

Numerous bath-chair supports are known, for instance:

U.S. Pat. No. 2,237,076 dated Apr. 1, 1941, as invented by Kenney et al, describes a swivel chair with a swivel to be rotatably mounted on a board seated on opposite sides of a bath;

U.S. Pat. No. 3,022,518 dated Feb. 27, 1962, as invented by Hayden, describes a swivel chair with a swivel foot to be seated in the bottom of a bath tub, and U.S. Pat. No. 5,263,207 dated Nov. 23, 1993, as invented by Gilbert, describes also a swivel chair with a swivel foot, but to be fixed on the floor adjacent to a bath; another similar chair with a foot, is described in U.S. Pat. No. 4,628,550 dated Dec. 16, 1986, as invented by Walton;

U.S. Pat. No. 5,150,482 dated Sep. 29, 1992, as invented by Shapiro, describes a bath chair swivel foot having a base with suction cups;

U.S. Pat. No. 2,052,628 dated Sep. 1, 1936, as invented by Higgins, describes a chair mounted on an arm which is pivotally mounted with special arrangements, to the front of a bath;

U.S. Pat. No. 5,287,568 dated Feb. 22, 1994, as invented by Mohrmann, describes a tilt lift bathing system mounted on a special bath.

U.S. Pat. No. 4,359,791 dated Nov. 23, 1982, as invented by Thomas, U.S. Pat. No. 4,253,203 dated Mar. 3, 1981, as invented by Thomas, U.S. Pat. No. 4,168,549 dated Sep. 25, 1979, as invented by Davies, and U.S. Pat. No. 2,648,849 dated Aug. 18, 1953, as invented by Webb et al, describe a bath chair slidable on a frame extending across the two longitudinal sides of a bath and beyond one of those sides;

U.S. Pat. No. 2,045,110 dated Jun. 23, 1936, as invented by Spiess, describes a chair mounted on bands which are rotatably mounted on a pulley system secured on each side of a bath.

All these bath-chair supports are cumbersome, and do require a good physical fitness of the manipulator, for fixing or removing these supports. Most often these bath-chair supports are permanently fixed, interfering with persons wishing to take a normal bath.

SUMMARY OF THE INVENTION

The invention aims at overcoming the above identified problems with a bath-chair support having means for rotatably mounting a chair thereon, and which is least cumbersome, occupies a limited space, is easy to remove and to fix, and is light weight, to be easily handled by an elderly person without particular danger of causing back aches.

Broadly stated the invention is directed to a compact bath-chair support comprising:

a frame having a bottom, said bottom defining a flat bottom surface for resting on top of an upwardly extending side of a bath, said side of a bath terminating at said top into an inverted U-shaped cross-section, said U-shaped cross-section defining opposite outer walls, said side of a bath having a thickness, said frame having two opposite sides:

said frame having, along one of said two opposite sides, at least one downwardly extending member having a flat surface acting as a jaw, said downwardly extending member being a member selected from the group consisting of members fixedly mounted and slidably mounted, onto said frame, above said flat bottom surface of said frame, and at least one downwardly extending member having a flat surface, and being slidably mounted along the side opposite said one of said two opposite sides, above said flat bottom surface of said frame, releasable clamping means for securely holding said at least one slidably mounted downwardly extending member, mounted to said frame above said bottom surface and operatively connected to said slidably mounted members, for said at least one downwardly extending member on said opposite side of said frame to keep against, be in intimate contact with, and frictionally engage one of said outer walls of said side of a bath, and for said at least one downwardly extending flat member acting as a jaw to keep against, be in intimate contact with, and frictionally engage the other of said outer walls of said side of a bath, for said downwardly extending flat members to securely hold said side of a bath near said top, in order to maintain said flat bottom surface of said frame against said top of a bath, and said frame defining above said bottom surface, at least one receptacle for receiving the shaft of a chair, whereby the weights of, and on said chair, and of said frame, via said flat bottom surface are transferred onto said top of an upwardly extending side of a bath, and said downwardly extending flat members are adjustable to securely hold the side of a bath and cooperate as jaws to releasably hold the upwardly extending side of a bath near said top, in order to maintain said flat bottom surface against said top.

Preferably the invention is directed to a compact bath-chair support as defined above wherein said releasable clamping means for securely holding said at least one slidably mounted downwardly extending member, moves said at least one slidably mounted downwardly extending member, for said at least one downwardly extending member on said opposite side of said frame alternately:

to move away from, said member on said one of said sides for releasing said members from said side of a bath, and to move toward said member on said one of said sides in order for said members to securely hold said side of a bath near said top.

By the expression: "inverted U-shaped cross-section" throughout the specification including the claims, is meant that the bath has a shape suitable for receiving the flat bottom surface, in order for said flat bottom surface to rest on top of an upwardly extending side of a bath.

In a preferred embodiment the invention is directed to a compact bath-chair support comprising:

a frame having a bottom, said bottom defining a flat bottom surface for resting on top of an upwardly extending side of a bath, said side of a bath terminating at said top into an inverted U-shaped cross-section, said side of a bath having a thickness, said flat bottom surface of said frame having opposite lateral and opposite longitudinal sides, said frame having, along one of said longitudinal sides, at least one downwardly extending member having a flat surface acting as a fixed jaw, and at least one movable L-shaped jaw, on the other of said longitudinal sides, slidably mounted on said frame, above a plane containing said flat bottom surface of said frame, and releasable clamping means for securely holding said at least one movable L-shaped jaw mounted to said frame above said plane containing said flat bottom surface and operatively connected to said at least one L-shaped movable jaw, for said at least one movable jaw, to move toward and away from, said at least one downwardly extending member acting as a fixed jaw of said one of said longitudinal sides, for said at least one downwardly extending member acting as a fixed jaw, and said at least one movable L-shaped jaw, cooperating to act as a vise, being adjustable to securely hold said side of a bath near said top, in order to maintain said flat bottom surface against said top, and alternately to release said jaws from said side of a bath, and said frame defining above said bottom surface, at least one receptacle for receiving the shaft of a chair, whereby the weights of, and on, said chair, and of said frame, via said flat bottom surface, are transferred onto said top of an upwardly extending side of a bath.

In another preferred embodiment the invention is directed to a compact bath-chair support comprising:

a block having a rectangular bottom, said bottom defining a flat bottom surface, for resting on top of an upwardly extending side of a bath, said side of a bath terminating at said top into an inverted U-shaped cross-section, said side of a bath having a thickness, said flat surface having opposite lateral and opposite longitudinal sides, said block having, along one of said longitudinal sides, at least one downwardly extending member acting as a fixed jaw fixedly mounted on said block, and at least one movable L-shaped member acting as a movable jaw, on the other of said longitudinal sides, said L-shaped member consisting of a downwardly extending portion defining a jaw and terminating into an outwardly projected slide piece, said slide piece being slidably mounted onto said block, above a plane containing said flat bottom surface, and clamping means positioned above said plane containing said flat bottom surface and operatively connected to said slide piece of said L-shaped member, for said at least one L-shaped member to move toward and away, from said at least one downwardly extending member acting as a fixed jaw of said one of said longitudinal sides, for said at least one downwardly extending member acting as a fixed jaw and said at least one movable L-shaped member to act as a vise, to securely hold said side of a bath near said top, in order to maintain said flat bottom surface against said top, and said block having at least one substantially vertical aperture for receiving the shaft of a chair, whereby the weights of, and on, said chair, and of said block, via said flat bottom surface, are transferred onto said top of an upwardly extending side of a bath, and said at least one downwardly extending member cooperates with said L-shaped member to securely hold the upwardly extending side of a bath, near said top, and thereby said bath-chair support is adjustable to securely hold and securely fit the side of a bath.

Further embodiments of the invention will be described herein below.

DESCRIPTION OF THE DRAWINGS

In the drawings which illustrate some of the preferred ways of carrying out the invention.

DESCRIPTION OF SOME OF THE PREFERRED WAYS OF CARRYING OUT THE INVENTION

Figure 1:
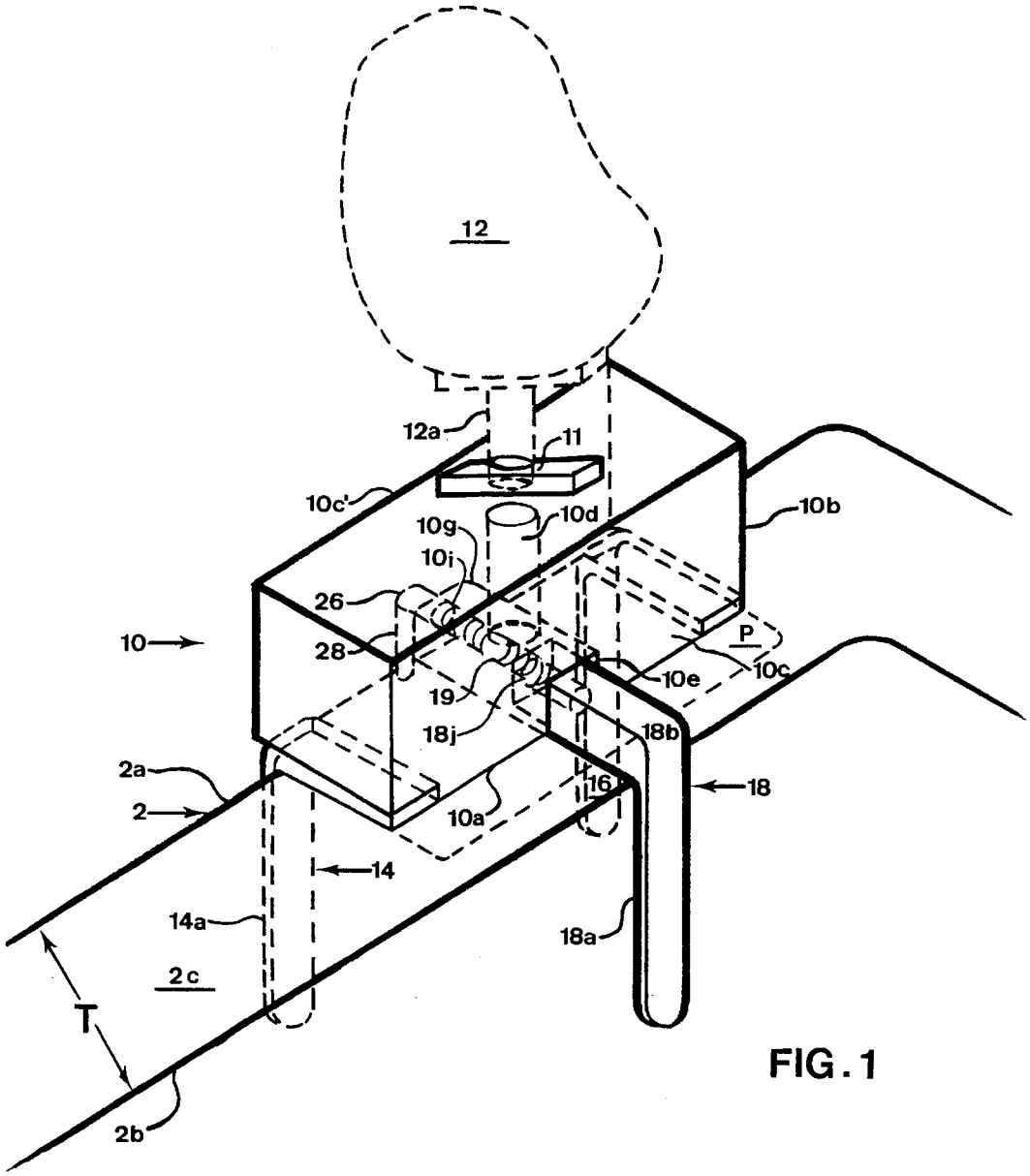
FIG. 1 is a perspective view of a compact bath-chair support slidably mounted over the side of a bath, near the top of said side with a chair shown in doted lines, said support having two downwardly extending members acting as fixed jaws and one slidably mounted, downwardly extending member.

As shown in FIG. 1, a compact bath-chair support 10 comprises a frame or block 10. The frame or block 10 has a bottom which defines a flat bottom surface 10*a* for resting on top of an upwardly extending side 2 of a bath, the side of the bath terminates at said top into an inverted U-shaped cross-section. The U-shaped cross-section defines opposite outer walls 2*a*, 2*b* and a top 2*c*. The side of the bath has a thickness "T". The bath-chair support is mounted over the side of a bath, near the top of said side, with a chair 12 (shown in smaller dimension relative to the frame or block 10) having a shaft 12*a*, shown in doted lines.

This flat bottom surface 10*a* improves frictional engagement with the top 2*c* of the side 2 of the bath. This flat bottom surface also enables weights exerted on the frame or block 10*a*, to be well spread under that flat bottom surface, over the top of the side of the bath. Mostly all the weights are thus spread over that top of the bath. For that reason and in order to obtain a good equilibrium, the sides of the frame or block, running across the top of the bath, such as side 10*b*, are preferably shorter than the thickness "T" of the side of the bath. In other words, the distance between the two opposite outer walls, (such as 10*c*, 10*c'*), receiving the downwardly extending members, is shorter than the thickness "T" of the side of a bath.

The frame or block has opposite lateral sides, such as the one 10*b*, and opposite longitudinal sides, such as 10*c*, 10*c'*. These sides may also have all equal lengths, that is both the lateral sides and the longitudinal sides may be equal, as to define a square flat bottom surface. The block or frame may also be circular, if desired, and thus having opposite sides, the sides not being limited to straight sides. The top of the block or the frame, needs not be square, as will be evidenced herein below.

The bath-chair support has two downwardly extending members 14, 16 acting as fixed jaws and one slidably mounted, downwardly extending member 18. In this FIG. 1, this slidable member 18 is positioned midway along one of said longitudinal sides.

It should be borne in mind, that the frame or block may have, along each of two opposite sides, at least one downwardly extending member, and on at least one of the opposite sides, at least one downwardly extending member, such as 18, is slidably mounted and provided with clamping means positioned above a plane containing the bottom surface and operatively connected to the members slidably mounted, for the at least one downwardly extending member on one of the opposite sides, to move toward and away from, the at least one downwardly extending member of the opposite side. Preferably all said downwardly extending members end all at the same distance away from the block as shown in the drawings, but need not be.

Preferably, these extending members 14, 16 are L-shaped, but, if desired may also be flat and be fixed to the side, for instance the longitudinal side.

For instance, with respect to the the slidably mounted member 18, the block 10 may define a housing, such as 10*e*, midway of the longitudinal side, but above an imaginary plane P containing the flat bottom surface 10*a*. The housing has a rectangular cross-section parallel to the longitudinal sides, and running substantially from one of the longitudinal sides to the other longitudinal side, and terminating near one of the longitudinal sides into a rectangular wall, such as 10*g*, having a circular aperture such as 10*i*, and the slidably mounted downwardly extending member 18 is L-shaped having an outwardly projected slide piece correspondingly rectangular cross-section such as at 18*b*, for snugly fitting and sliding inside the housing 10*e*, the outwardly projected slide piece being substantially perpendicular to the downwardly extending portion defining a jaw such as 18*a*, and having fixedly mounted therein a threaded female element such as 18*j*.

An adjusting screw, such as 19, is rotatably mounted about the circular aperture 10*i*, to the rectangular wall and engaging the threaded female element 18*j*. This screw 19 may be rotatably mounted about the circular aperture 10*i*, by an outside coupling sleeve 26 bridging the adjusting screw 19 to a hand-lever 28 or as will be discussed in FIG. 2.

Thus, said members act with the clamping means, as a vise, to securely hold the side of a bath near the top, in order to maintain said flat bottom surface against said top, and for moving said at least one downwardly extending member on one side, toward and away from said at least one downwardly extending member of the other side, and said frame or said block defines above the bottom surface, at least one receptacle for receiving the shaft of a chair, for instance by having a substantially vertical aperture such as 10*d*, whereby the weights of, and on, the chair, and of the frame or the block, via the flat bottom surface, are transferred onto top of an upwardly extending side of a bath, and the downwardly extending members cooperate to securely hold the upwardly extending side of a bath near said top, and thereby said bath-chair support is adjustable to securely hold or fit the side of a bath.

Preferably the chair has a flat bottom surface as shown, for directly seating said bottom, on top of the frame or block 10. Or if the shaft 12*a* is too long for doing so, by providing an intermediate perforated plate such as 11, for distributing part of the weight from the chair to the frame or block 10.

It should be borne in mind that the frame must have, along one of the sides, at least one downwardly extending member acting as a jaw, that member being a member selected from the group consisting of members fixedly mounted and slidably mounted, onto the frame, above an imaginary plane containing the flat bottom surface, and at least one downwardly extending member slidably mounted on the side opposite said one of said sides, and above an imaginary plane containing the flat bottom surface.

Figure 2:
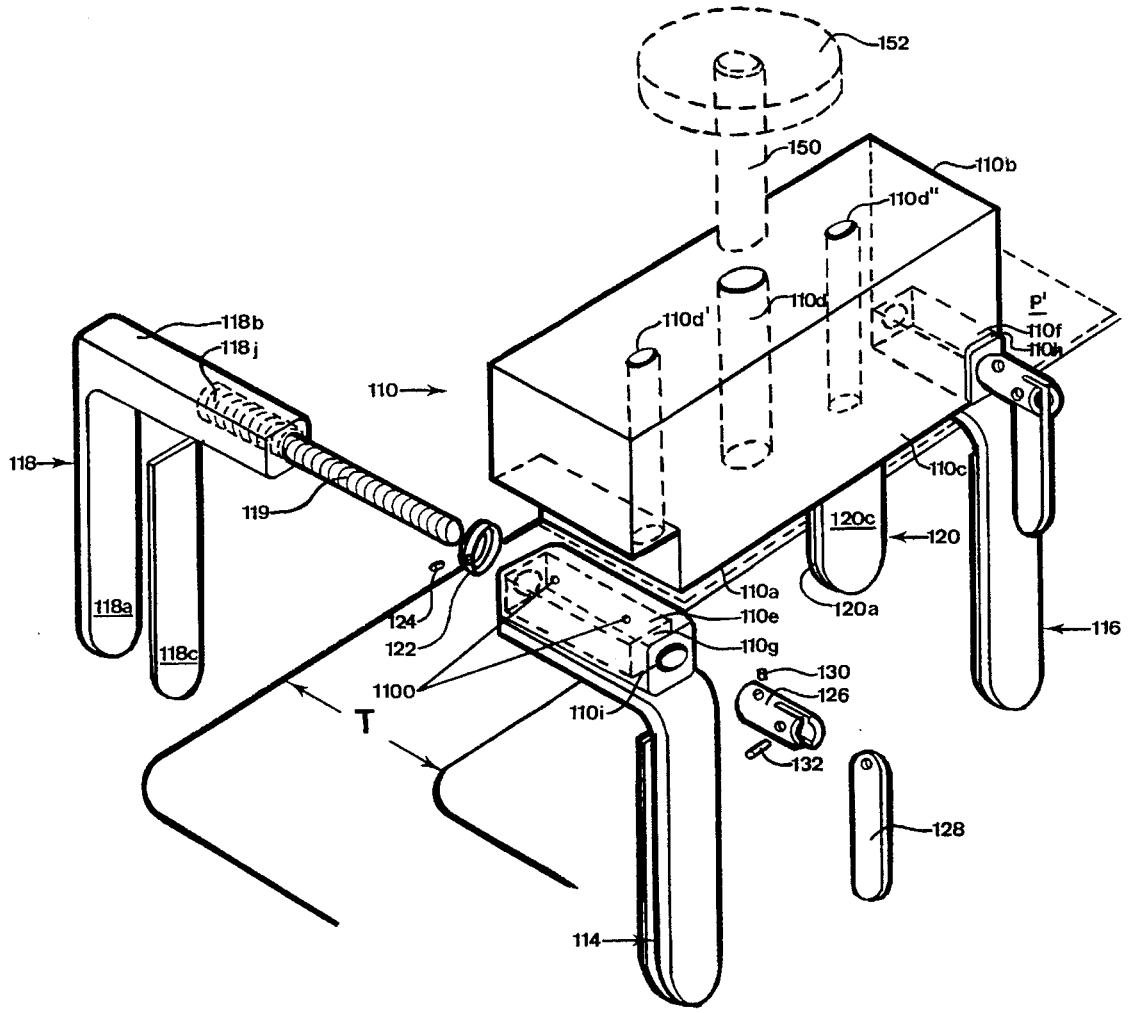
FIG. 2 is a partly exploded view of another compact bath-chair support having two downwardly extending members acting as fixed jaws and two slidably mounted, downwardly extending members.

As shown in FIG. 2, the compact bath-chair support comprises a block 110 having a rectangular bottom 110*a* which defines a flat bottom surface, for resting on top of an upwardly extending side of a bath. As already explained above, that side of a bath terminates at the top into an inverted U-shaped cross-section, the side of a bath having a thickness "T".

That flat bottom surface of the block, has opposite lateral sides, such as side 110*b*, and opposite longitudinal sides, such as side 110*c*.

The block has along one of the longitudinal sides, at least one downwardly extending member, such as 114, 116, acting as a fixed jaw fixedly mounted on the block, and at least one movable L-shaped member, such as 118, 120, acting as a movable jaw, on the other of said longitudinal sides.

Each of the L-shaped members consists in a downwardly extending portion defining a jaw, such as 118*a* and 120*a*, terminating into an outwardly projected slide piece, such as 118*b*. The slide piece is slidably mounted onto the block, above an imaginary plane, as shown in dotted lines at P', containing the flat bottom surface 110*a*. Clamping means are positioned above the imaginary plane P' containing the bottom surface and operatively connected to the slide piece of the L-shaped member, for said at least one L-shaped member to move toward and away, from said at least one downwardly extending member acting as a fixed jaw of said one of said longitudinal sides, for said at least one downwardly extending member acting as a fixed jaw, such as 114, 116, and said at least one movable L-shaped member, such as 118 and 120, to act as a vise, to securely hold said side of a bath near said top, in order to maintain the flat bottom surface 110*a* against said top of said bath.

The block has at least one substantially vertical aperture or female receptacle, such as 110*d*, for sliding therein so as to be quickly releaseably mounted, the shaft 150 of a chair having a seat, but may have additional apertures, and of various sizes, if desired, as shown in dotted lines at 110*d'* and 110*d"*. The shaft may, if desired, be provided with a spacer or perforated plate, such as shown at 152 for transmitting the weight of the chair to the top of the block 110. This is in order for said shaft to be rotatably mounted within said block like frame into said female receptacle within said block like frame, and to allow strictly rotational and axial displacements of said shaft, and said shaft for snugly fitting within said female receptacle in order to prevent radial displacements of said chair from said shaft and thereby preventing side-displacements of said chair from said block, and to allow the bottom of said seat to be in close proximity to the top of said block, and said chair to be removed upon mere pulling of said shaft from said female receptacle.

Thus the weights of, and on, a chair being transferred to said top of said block or block frame, and from the block or block like frame, the weights being spread, via said flat bottom surface of said block like frame, are transferred onto the top of an upwardly extending side of a bath, for the center of gravity of all the weights of and on said chair, and of said block, each taken individually, to be within said upwardly extending side of a bath, and the downwardly extending members acting as fixed jaws cooperate with the L-shaped members, to securely hold the upwardly extending side of a bath, near the top, and thereby the bath-chair support is adjustable to securely fit the side of a bath, in order to maintain the flat bottom surface 110*a* against that top.

That block 110 defines housings, such as 110*e* and 110*f*, along each of the lateral sides such as 110*b*, but above the imaginary plane P' containing the flat bottom surface 110*a*.

Each housing has a rectangular cross-section, that cross-section is parallel to the longitudinal sides, and running substantially from one of the longitudinal sides to the other longitudinal side, and terminating near one of the longitudinal sides into a rectangular wall, such as 110*g* and 110*h*, having a circular aperture such as 110*i*, and each outwardly projected slide piece of the L-shaped member, has a correspondingly rectangular cross-section, such as at 118*b*, for snugly fitting and sliding inside the housings 110*e* and 110*f*.

The outwardly projected slide piece, such as 118*b*, is substantially perpendicular to the downwardly extending portion defining a jaw, such as 118*a*, and has fixedly mounted therein a threaded female element, such as 118*j*. An adjusting screw, such as 119, is rotatably mounted about the circular aperture 110*i*, to the rectangular wall and engaging the threaded female element 118*j*. This screw 119 may be rotatably mounted about the circular aperture 110*i*, by means of a retaining means for example, an inner round nut 122 fastened to the adjusting screw with a grub screw 124 or other locking devices, and by an outer retaining means, for example an outside coupling sleeve 126 bridging the adjusting screw 119 to a hand-lever 128 with grub screws 130, 132. As is easily seen, this adjusting screw having a threaded element is rotatably mounted to allow strict rotational displacements of said threaded element: this adjusting screw having a threaded element, being operatively connected to said at least one slidably mounted downwardly extending member in order to positively move said at least one slidably mounted downwardly extending member, for said at least one downwardly extending member on said opposite side of said block like frame in alternately:

to be drivenly moved away from, said member on said one of said sides for releasing said members from said side of a bath, by said adjusting screw having a threaded element, and to be drivenly moved toward said member on said one of said sides in order for said members to securely hold said side of a bath near said top, for quick positioning and removal of said compact bath-chair support, by said adjusting screw having a threaded element.

Instead, the coupling sleeve 126 may simply be T-shaped or even a wing nut secured to the adjusting screw 119 with a grub screw.

As shown, the block 110 may be cut in the lower corners to receive the housings, such as 110*e*, 110*f*. The housing such as 110*e*, may be a hollow bar having orifices 110*o* for receiving screws or counter sunk head screws, not shown for sake of clarity.

This illustrates one of the clamping means for moving the L-shaped member, toward and away from the downwardly extending members of the other longitudinal side, the adjusting screw acting as the clamping means.

As can also be seen in FIG. 2, the downwardly extending members acting as fixed jaws, 116, 114, are each integral with a housing, and extend as to be face to face with a downwardly extending portion defining the jaw of an L-shaped member, and thereby the block has opposite pairs of fixed jaws and L-shaped members.

The downwardly extending members, such as 114, 116 acting as fixed jaws, and the downwardly extending portions defining a jaw such as 118*a* and 120*a* are preferably padded flat bars, with rubber pads or polymeric material: for instance polyfluoro compounds such as Teflon™ or vinyl, as more clearly shown at 118*c* and 120*c*, Teflon™ being a trademark for a polyfluoro compound.

In a particular embodiment, the block may be a wood block and the extending members stainless steel flat bars, the slide pieces and the housings hollow square bars.

Figure 3:
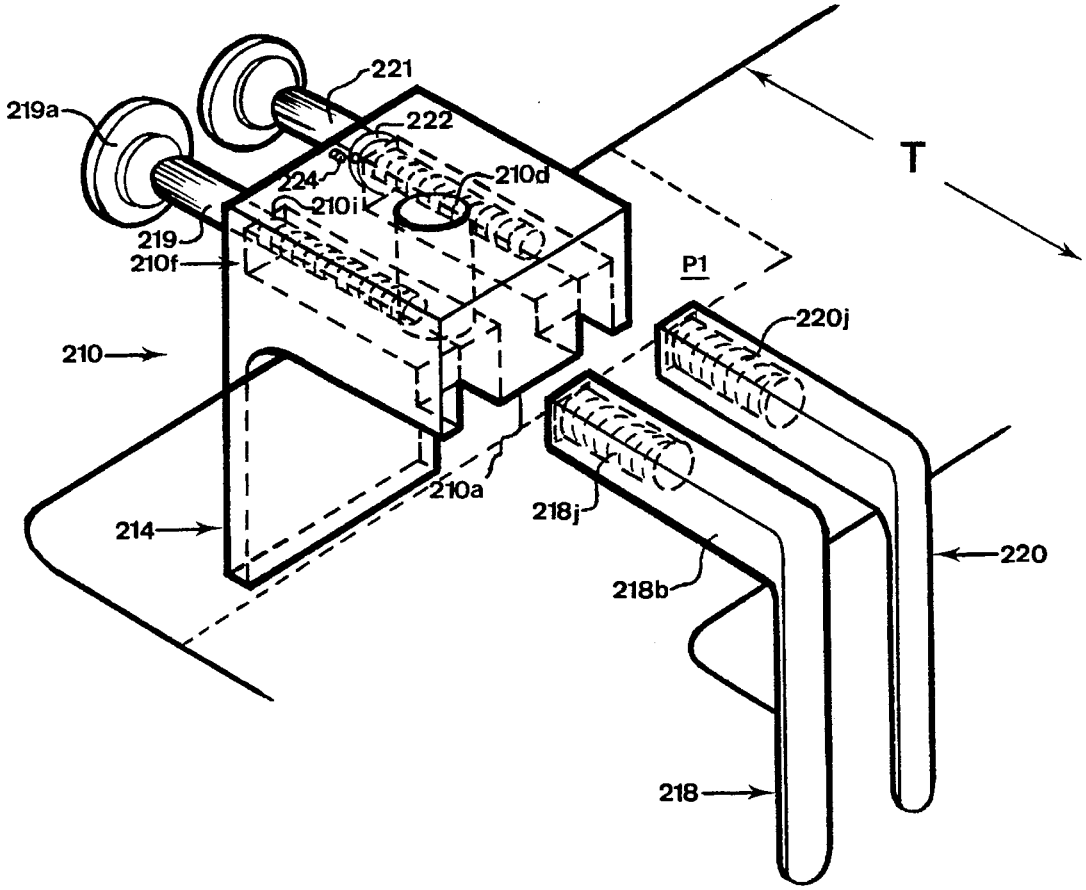
FIG. 3 is a perspective view, partly exploded, of another compact bath-chair support having one downwardly extending member acting as a fixed jaw and two slidably mounted, downwardly extending members.

As shown in FIG. 3, the compact bath-chair support comprises a frame 210 having integral therewith, along one of two opposite sides, only one downwardly extending member 214 acting as a fixed jaw, and two movable L-shaped jaws 218, 220 on the other opposite side, slidably mounted on the frame, above an imaginary plane $P_1$ (in dotted lines) containing the flat bottom surface 210*a*, in the grooves defined in said frame. The grooves are stopping short of said one side, in order to define a wall, such as 210*f* closing each of the grooves at said one side. As shown, the frame 210 needs not be rectangular, but may also be a square, though preferably rectangular if a higher stability of the frame on the top of a bath is desired. Instead of closing the grooves with a wall such as 210*f*, if desired a supporting bracket may be provided in order to have rotatably mounted thereon the adjusting screws 219, 221 as discussed herein below.

The clamping means are positioned above the plane $P_1$ containing the bottom surface, and operatively connected to the movable jaws, for these movable jaws to move toward and away from, the downwardly extending member acting as a fixed jaw, for the one downwardly extending member acting as a fixed jaw, and the two movable L-shaped jaws, to act as a vise, to securely hold said side of a bath near said top, thereby cooperating to releasably hold an upwardly extending side of a bath near the top, in order to maintain the flat bottom surface 210*a* against that top, and thereby the bath-chair support is adjustable to securely fit the side of a bath.

The frame has above the bottom surface, one receptacle 210*d* for receiving the shaft of a chair.

Thereby the weights of, and on, the chair, and of the frame, via the flat surface, are transferred onto the top of an upwardly extending side of a bath.

This structure may be molded with stainless steel, high density polymers having high strength, for instance nylon, polypropylene, polyethylene.

The outwardly projected slide piece 218*b*, of the L-shaped member 218, and similarly for the L-shaped member 220, are female threaded, such as 218*j* and 220*j*, for receiving an adjusting screw such as 219, and similarly 221 for 220*j*. The adjusting screw is rotatably mounted about a circular aperture, for instance 210*i*, in the frame 210. This screw 219 may be rotatably mounted about the circular aperture 210*i*, by a shaft having at one end a handle 219*a* and being threaded thereafter, a shoulder between the threads and the unthreaded portion being thus defined for confining the handle outside.

In order to prevent sliding of the slide piece 218*b* and the shaft, when there is a gap between the slide piece and the wall 210*f* closing the groove, the shaft may be provided with an inner round nut 222 fastened on adjusting screw 221, to the threads with a grub screw 224 or other locking devices. This illustrates another clamping means for moving the L-shaped member, toward and away from the downwardly extending members of the other longitudinal side, the adjusting screw acting as the clamping means.

Figure 4:
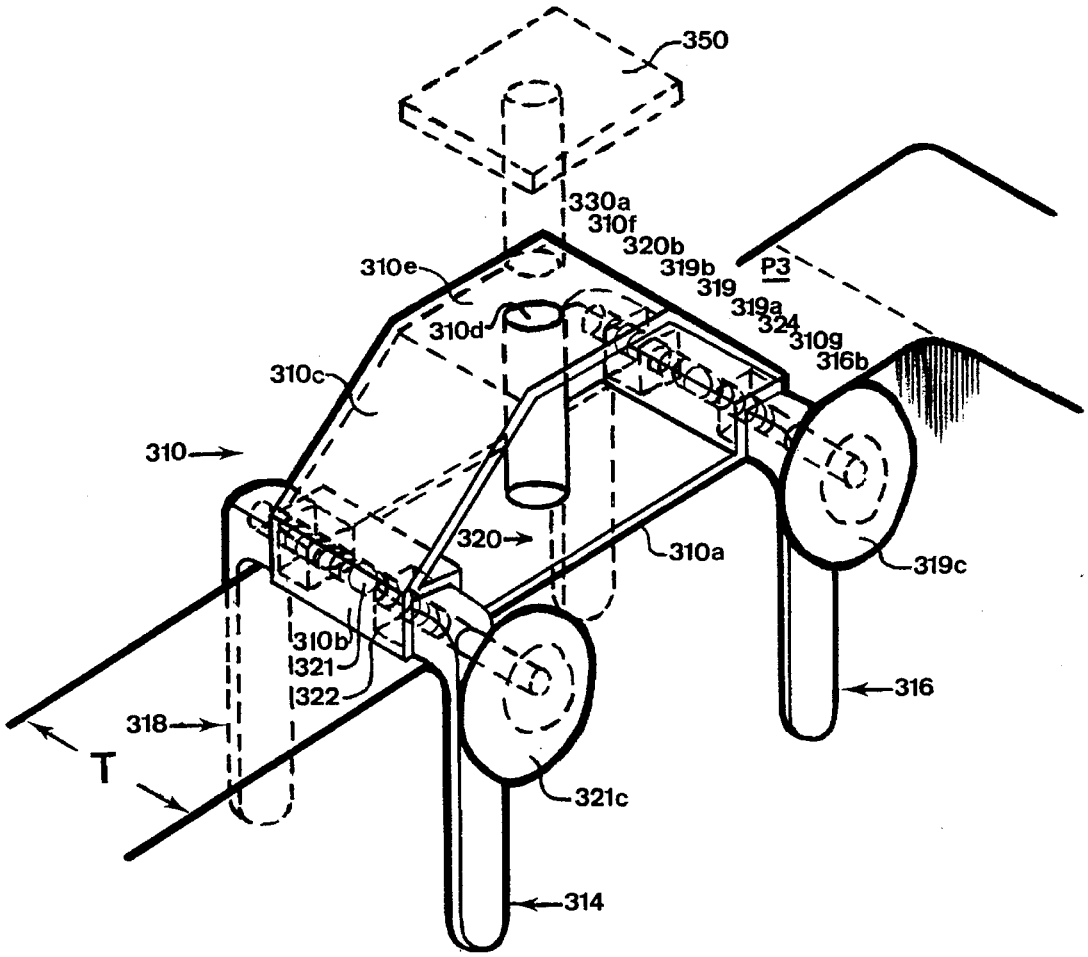
FIG. 4 is a perspective view of another compact bath-chair support having two pairs of opposite, slidably mounted, downwardly extending members.

As shown in FIG. 4, the compact bath-chair support comprises a frame 310 having a bottom 310*a*, that bottom defining a flat bottom surface for resting on top of an upwardly extending side of a bath. This support needs not be a cube or a quadratic or rectangular full body, but may also be an empty body for instance, as defined by the pyramid having folded sides 310*a*, 310*b*, 310*c*, 310*e*, 310*f* and 310*g*. The side 310*e* has a sleeve 310*d*, acting as means to receive the shaft 330*a* of a chair, and if desired a spacer 350.

The frame has along each of two opposite sides, two movably mounted downwardly extending members 314, 318, and 316, 320 respectively, acting as movable jaws. Each jaw has a slide piece, such as 316*b*, 320*b*.

Two slide pieces such as 316*b* and 320*b* are paired to a common screw 319 which is threaded for about half its length clockwise such as 319*a* and the other half counterclockwise such as 319*b*, and similarly for the threads of the engaging slide pieces, in order for that screw to simultaneously bring together, or to move away the slide pieces so paired and thus said elongated members. Each pair of slide pieces is slidably mounted in a single housing, such as 322, 324, which has open ends. Each common screw such as 319, 321 terminates at one end into a handle such as 319*c*, 321*c*. This being another illustration of clamping means.

Figure 5:
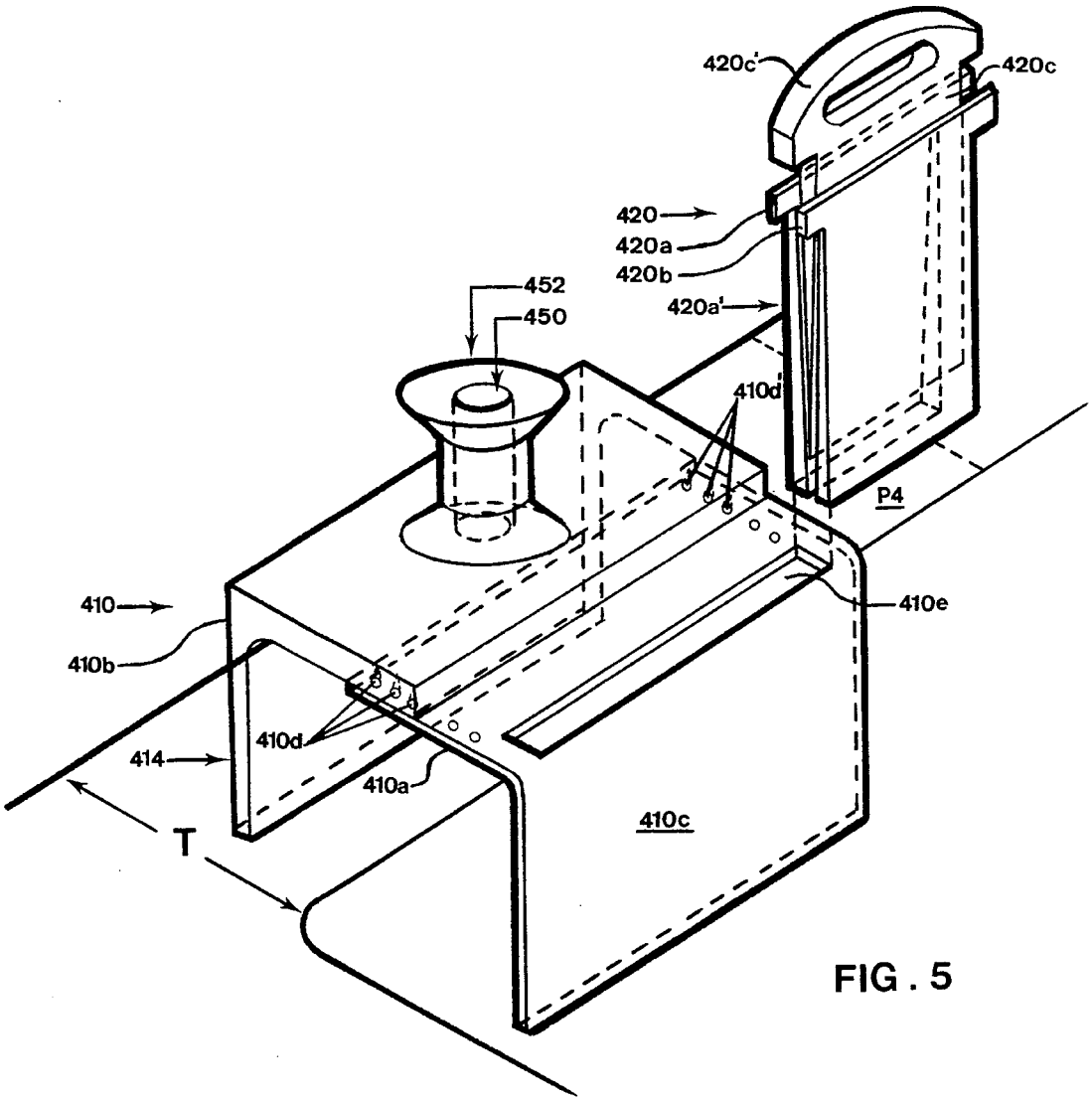
FIG. 5 is a perspective view, partly exploded, of another compact bath-chair support.

As shown in FIG. 5, though less preferred, the compact bath-chair support comprises a frame 410 having a bottom 410*a* defining a flat bottom surface for resting on top of an upwardly extending side of a bath, said side of a bath terminating at said top into an inverted U-shaped cross-section, said U-shaped cross-section defining opposite outer walls, said side of a bath having a thickness.

The frame has two opposite sides 410*b* and 420:

said frame has, along one of said two opposite sides, at least one downwardly extending member, e.g. side 410*b*, having a flat surface acting as a jaw, said downwardly extending member being a member fixedly mounted onto said frame by being integral therewith, and above said flat bottom surface 410.

At least one downwardly extending member, such as 420, has a wall with flat surface 420*a*', and is slidably mounted along the side opposite said one (410*b*) of said two opposite sides, above said flat bottom surface 410*a*.

The member 420 consists in a pair of T-shaped walls 420*a* and 420*b* having a gradually reduced thickness or a tapering thickness, at their top, and sandwiching a slidably mounted T-shaped wedge 420*c* tapering at its bottom. The frame further includes a pre-adjusted L-shaped wall 410*c*, mounted with screws such as 410*d*, 410*d*' or other fastening means, and having a slot 410*e*. The member 420, comprising the wall 420*a*, is thus slidable in the slot 410*e*, until the upper portion of the T-shaped walls 420*a* and 420*b* rest against the surface of the wall surrounding the slot 410*e*.

The member 420 cooperates with the wall 410*c* which just acts as a guide, in order to prevent displacements of the member 420, away from the side of the bath. Thus member 420 acts as still another clamping means mounted to said frame 410, above said bottom surface 410*a*, and operatively connected to said member 420*a*, within member 420, slidably mounted.

Thus, said at least one downwardly extending member on the side 420 opposite said one 410*b* of said two opposite sides, brings said at least one downwardly extending flat member acting as a jaw against one of the opposite outer walls of said U-shaped cross-section of a bath, by exerting with said at least one downwardly extending flat member 420*a*, within member 420, slidably mounted along the side opposite said one of said two opposite sides, a pressure with said T-shaped wedge 420*c*, against said other of the opposite outer walls 420*a* of said U-shaped cross-section of a bath, while wall 420*b* remains in position because of the supporting wall 410*c* against which it rests;

for said downwardly extending flat members to act as a vise, to securely hold said side of a bath near said top and be in intimate contact with said side, in order to maintain said flat bottom surface against said top.

The frame 410 defines above the bottom surface 410*a*, at least one receptacle 452, for receiving the shaft of a chair, which may comprise or not, a spacer 450, whereby the weights of, and on said chair, and of said frame, via said flat bottom surface, are transferred onto said top of an upwardly extending side of a bath, and said downwardly extending flat members are adjustable to securely fit the side of a bath and cooperate as jaws to releasably hold the upwardly extending side of a bath near said top, in order to maintain said flat bottom surface against said top.

It should be noted that the member 420, can also do away with the T-shaped wall 420*b*, if one wishes.

Also this wedge action can simply be performed with a wall 420*a* having a V-shaped cross-section and a wall 410*c* having a correspondingly inverted V-shaped cross-section, the wall 420*a* acting simultaneously as said downwardly extending member having a flat surface and being slidably mounted and cooperating with said wall 410*c*, as said clamping means exerting a pressure against said other of the opposite outer walls 420*a* of said U-shaped cross-section of a bath.

Conveniently, the T-shaped wedge 420*c*, is provided with a handle 420*c*'.

Also, the receptacle for receiving the shaft of a chair may have other shapes, for instance it is a bobbin-like receptacle 452, mounted over the shaft 450 of a chair between the chair and the frame of the bath-chair support, or the bobbin may be fixedly mounted to the bath-chair support.

Also, the receptacle for receiving the shaft of a chair may simply be a tubular element upwardly directed and fixedly mounted to said bottom.

In the bath-chair support as shown in FIGS. 1–4, the movable jaw is an L-shaped member consisting of:

a first downwardly extending portion defining a jaw, an intermediate outwardly projected slide piece, and said slide piece being slidably mounted above said plane containing said bottom surface, for said first downwardly extending portion defining a jaw, to move toward and away from, said at least one downwardly extending member acting as a fixed jaw of said one longitudinal side, and bridging said first downwardly extending portion to at least one threaded male portion, said at least one threaded male portion is within or in a same plane as, said intermediate outwardly projected slide piece, said frame, on said one longitudinal side and above said flat bottom surface, defining at least one aperture for receiving said at least one threaded male portion above said plane containing said bottom surface, and nut means for engaging said at least one threaded male portion and for urging said nut means against said frame and thereby acting as said clamping means.

The nut means may be a member selected from the group consisting of nuts, wing nuts, T-shaped nuts and inner threaded sleeve terminating with a shoulder, and in the case of a nut, a suitable key may be temporary used for the adjustment against a bath so that in the absence of the suitable key, this bath-chair support cannot be removed and should remain until a permission is given otherwise and the suitable key provided.

Preferably, as shown in the drawings, the flat surface of the bottom of the frame, extends as much as possible over the top of the upwardly extending side of the bath.

EXAMPLE

A bath-chair support was made as shown in FIG. 2, wherein the block is 3×3×8 inches illustrating the compactness of that support.

While some of the preferred embodiments have been described herein above, it is to be understood that the invention is not to be construed as limited to these preferred embodiments, as many modifications and variations are possible within the spirit and scope of the appended claims.

I claim:

1. A compact bath-chair support comprising:

a block like frame having a top, a bottom, opposite lateral sides, two opposite longitudinal sides and a central portion between said two opposite longitudinal sides, said bottom defining a flat bottom surface for resting on top of an upwardly extending side of a bath, said side of a bath terminating at said top into an inverted U-shaped cross-section, said U-shaped cross-section defining opposite outer walls, said side of a bath having a thickness, said block like frame having, along one of said two opposite longitudinal sides, at least one downwardly extending member having a flat surface acting as a jaw, mounted onto said block like frame, above said flat bottom surface of said block like frame, and at least one downwardly extending member having a flat surface, and being slidably mounted along the side opposite said one of said two opposite longitudinal sides, above said flat bottom surface of said block like frame, releasable clamping means for securely holding said at least one slidably mounted downwardly extending member, for said at least one downwardly extending member on said opposite side of said block like frame to keep against, be in intimate contact with, and frictionally engage one of said outer walls of said side of a bath, and for said at least one downwardly extending flat member acting as a jaw to keep against, be in intimate contact with, and frictionally engage the other of said outer walls of said side of a bath, for said downwardly extending flat members to securely hold said side of a bath near said top, in order to maintain said flat bottom surface of said block like frame against said top of a bath, and said block like frame defining above said bottom surface, but within said block up to said top, and along said central portion of said block like frame, at least one female receptacle for sliding therein so as to be quickly releaseably mounted, the shaft of a chair having a seat, in order for said shaft to be rotatably mounted within said block like frame into said female receptacle within said block like frame, and to allow strictly rotational and axial displacements of said shaft, and said shaft for snugly fitting within said female receptacle in order to prevent radial displacements of said chair from said shaft and thereby preventing side-displacements of said chair from said block, and to allow the bottom of said seat to be in close proximity to the top of said block, and said chair to be removed upon mere pulling of said shaft from said female receptacle, whereby the weights of, and on said chair being transferred to said top of said block like frame, and from said block like frame the weights being spread, via said flat bottom surface of said block like frame, are transferred onto said top of an upwardly extending side of a bath, for the center of gravity of all the weights of and on said chair, and of said block, each taken individually, to be within said upwardly extending side of a bath, and said downwardly extending flat members are adjustable to securely fit the side of a bath and cooperate as jaws to releasably hold the upwardly extending side of a bath near said top, in order to maintain said flat bottom surface against said top.

2. The compact bath-chair support as defined in claim 1, wherein said releasable clamping means for securely holding said at least one slidably mounted downwardly extending member is an adjusting screw having a threaded element rotatable mounted to allow strict rotational displacements of said threaded element, said adjusting screw having a threaded element, being operatively connected to said at least one slidably mounted downwardly extending member in order to positively move said at least one slidably mounted downwardly extending member, for said at least one downwardly extending member on said opposite side of said block like frame in alternately:

to be drivenly moved away from, said member on said one of said sides for releasing said members from said side of a bath, by said adjusting screw having a threaded element, and to be drivenly moved toward said member on said one of said sides in order for said members to securely hold said side of a bath near said top, for quick positioning and removal of said compact bath-chair support, by said adjusting screw having a threaded element.

3. The bath-chair support as defined in claim 1, wherein the distance between said two opposite longitudinal sides of said block like frame is shorter than said thickness of said side of a bath, for said block to stop short of said side of a bath, and said longitudinal sides being longer than said lateral sides.

4. A compact bath-chair support comprising:

a block having a top, a bottom, opposite lateral sides, two opposite lateral sides and a central portion between said two opposite longitudinal sides, said bottom defining a flat bottom surface for resting on top of an upwardly extending side of a bath, said side of a bath terminating at said top into an inverted U-shaped cross-section, said side of a bath having a thickness, said flat bottom surface of said block having opposite lateral and opposite longitudinal sides, said block having, along one of said longitudinal sides of said flat bottom surface, at least one downwardly extending member having a flat surface acting as a fixed jaw, and at least one movable L-shaped jaw, on the other of said longitudinal sides of said flat bottom surface, slidably mounted on said block, above a plane containing said flat bottom surface of said block, and releasable clamping means for securely holding said at least one movable L-shaped jaw mounted to said block above said plane containing said flat bottom surface and operatively connected to said at least one L-shaped movable jaw, for said at least one movable jaw, to move toward and away from, said at least one downwardly extending member acting as a fixed jaw of said one of said longitudinal sides, for said at least one downwardly extending member acting as a fixed jaw, and said at least one movable L-shaped jaw cooperating to act as a vise, being adjustable in order to alternately:

securely hold said side of a bath near said top, in order to maintain said flat bottom surface against said top, and to release said jaws from said side of a bath, and said block defining above said bottom surface but within said block up to said top, and along said central portion of said block, at least one female receptacle for sliding therein so as to be quickly releasably mounted, the shaft of a chair having a seat, in order for said shaft to be rotatably mounted within said block into said female receptacle within said block, and to allow strictly rotational and axial displacements of said shaft, and said shaft for snugly fitting within said female receptacle in order to prevent radial displacements of said chair from said shaft and thereby preventing side-displacements of said chair from said block, and to allow the bottom of said seat to be in close proximity to the top of said block, and said chair to be removed upon mere pulling of said shaft from said female receptacle, whereby the weights of, and on, said chair being transferred via said top of said block, and from said top of said block the weights being spread, via said flat bottom surface of said block, are transferred onto said top of an upwardly extending side of a bath, for the center of gravity of all the weights of and on said chair, and of said block, each taken individually, and together, to be within said upwardly extending side of a bath, and said downwardly extending flat members are adjustable to securely fit the side of a bath and cooperate as jaws to releasably hold the upwardly extending side of a bath near said top, in order to maintain said flat bottom surface against said top.

5. The bath-chair support as defined in claim 4, wherein said receptacle for receiving the shaft of a chair is tubular, running from said top of said block and stopping short of said flat bottom surface of said block.

6. The bath-chair support as defined in claim 4, wherein said block defines a symmetrical longitudinal axis and a symmetrical lateral axis, and said block has a substantially cylindrical vertical aperture along the meeting point of said symmetrical longitudinal axis and a symmetrical lateral axis, for receiving the shaft of a chair, said aperture being said female receptacle for receiving the shaft of a chair.

7. The bath-chair support as defined in claim 4, wherein said at least one movable L-shaped jaw consists of a downwardly extending portion defining a jaw, and joining an outwardly projected slide piece, and said slide piece being slidably mounted, above said plane containing said bottom surface, unto said block, for said downwardly extending portion defining a jaw to move toward and away, from said at least one downwardly extending member acting as a fixed jaw of said one of said longitudinal sides, said slide piece is provided with a threaded female element, above said plane containing said bottom surface, and said releasable clamping means for securely holding said at least one movable L-shaped jaw is an adjusting screw rotatably mounted to said block, above said plane containing said bottom surface, adjacent to said one of said longitudinal sides, and engaging said threaded female element of said slide piece driving said movable L-shaped jaw, toward and away from said at least one downwardly extending member acting as a fixed jaw of said one of said longitudinal sides, said screw being rotatably mounted as to allow strictly rotational displacement without translational displacement.

8. The bath-chair support as defined in claim 4, wherein said at least one downwardly extending member, acting as a fixed jaw, consists in two downwardly extending members: one along said one of said longitudinal sides of said flat bottom surface near one of said lateral side of said flat bottom surface, and the other one along said one of said longitudinal sides of said flat bottom surface near the other of said lateral sides of said flat bottom surface.

9. The bath-chair support as defined in claim 4, wherein said at least one movable L-shaped jaw consists in two downwardly extending members:

one along said other of said longitudinal sides near one of said lateral side, and the other one along said other of said longitudinal sides near the other of said lateral sides of said flat bottom surface.

10. The bath-chair support as defined in claim 4, wherein said at least one movable L-shaped jaw consists in one downwardly extending member positioned along said other of said longitudinal sides, and midway between said lateral sides, of said flat bottom surface.

11. The bath-chair support as defined in claim 4, wherein said movable L-shaped jaw consists in:

a first downwardly extending portion defining a jaw, an intermediate outwardly projected slide piece, and said slide piece being slidably mounted on said block, above said plane containing said bottom surface, for said first downwardly extending portion defining a jaw, to move toward and away from, said at least one downwardly extending member acting as a fixed jaw of said one longitudinal side, said intermediate outwardly projected slide piece defining a threaded female portion, and bridging said first downwardly extending portion to a rotatably mounted, manually operated adjusting screw having a threaded male portion engaging said female portion, said adjusting screw having a threaded male portion being in a same plane as said intermediate outwardly projected slide piece, said block, on said one longitudinal side and above said flat bottom surface, defining at least one aperture for receiving said adjusting screw having a threaded male portion above said plane containing said bottom surface, said adjusting screw having a threaded male portion, having opposite ends, retaining outer nut means fixably mounted to one of said opposite ends of said adjusting screw having a threaded male portion and for urging said nut means against said block and thereby acting as said clamping means, and an inner retaining means for preventing displacements towards said L-shaped jaws, of said adjusting screw having threaded male portion being rotatably mounted, as to allow strictly rotational displacement without translational displacement of said screw.

12. The bath-chair support as defined in claim 11, wherein said aperture is sandwiched between said inner retaining mean and said retaining outer nut means.

13. A compact bath-chair support comprising:

a block having a top, a bottom, opposite lateral sides, two opposite lateral sides and a central portion between said two opposite longitudinal sides, a rectangular bottom, said bottom defining a flat bottom surface, for resting on top of an upwardly extending side of a bath, said side of a bath terminating at said top into an inverted U-shaped cross-section, said side of a bath having a thickness, said flat bottom surface having opposite lateral and opposite longitudinal sides, said block having, along one of said longitudinal sides of said flat bottom surface, at least one downwardly extending member acting as a fixed jaw fixedly mounted on said block, and at least one movable L-shaped member acting as a movable jaw, on the other of said longitudinal sides of said flat bottom surface, each of said L-shaped members consisting of a downwardly extending portion defining a jaw and terminating into an outwardly projected slide piece, said slide piece being slidably mounted onto said block, above a plane containing said flat bottom surface, and clamping means positioned above said plane containing said bottom surface and operatively connected to said slide piece of said L-shaped members, for said at least one L-shaped member to move toward and away, from said at least one downwardly extending member acting as a fixed jaw of said one of said longitudinal sides, for said at least one downwardly extending member acting as a fixed jaw and said at least one movable L-shaped member to act as a vise, to securely hold said side of a bath near said top, in order to maintain said flat bottom surface against said top, and said block having above said bottom surface, but within said block up to said top, and along said central portion of said block like frame, one substantially vertical aperture for sliding therein so as to be quickly releaseably mounted, the shaft of a chair having a seat, in order for said shaft to be rotatably mounted within said block into said vertical aperture within said block, and to allow strictly rotational and axial displacements, and said shaft for snugly fitting within said vertical aperture in order to prevent radial displacements of said chair from said shaft and thereby prevent side-displacements of said chair from said block, and to allow the bottom of said seat to be in close proximity to the top of said block, and said chair to be removed upon mere pulling of said shaft from said female receptacle, whereby the weights of, and on, said chair, being transferred to said top of said block, and of said block the weights being spread, via said flat bottom surface of said block, are transferred onto said top of an upwardly extending side of a bath, for the center of gravity of all the weights of and on said chair, and of said block, each taken individually, to be within said upwardly extending side of a bath, and said at least one downwardly extending member cooperates with said L-shaped member to securely hold the upwardly extending side of a bath, near said top, and thereby said bath-chair support is adjustable to securely fit the side of a bath, in order to maintain said flat bottom surface against said top.

14. The bath-chair support as defined in claim 13, wherein for each of said L-shaped members acting as a movable jaw, said block defines a housing above said plane containing said bottom surface, said housing having a rectangular cross-section, said cross-section being parallel to said longitudinal sides, and running substantially from said one of said longitudinal sides to said other of said longitudinal sides, and terminating near said one of said longitudinal sides into a rectangular wall having a circular aperture, and said outwardly projected slide piece defines a correspondingly rectangular cross-section, for snugly fitting and sliding inside said housing, said outwardly projected slide piece being substantially perpendicular to said downwardly extending portion defining a jaw, and having fixedly mounted therein a threaded female element, an adjusting screw rotatably mounted about said circular aperture of said housing, to said rectangular wall and engaging said threaded female element, for moving said at least one L-shaped member, toward and away from said at least one of said downwardly extending members of the other longitudinal side, said operatively connected screw being said clamping means, and retaining outer nut means fixably mounted to one of said opposite ends of said adjusting screw having a threaded male portion and for urging said nut means against said block and thereby acting as said clamping means, and an inner retaining means for preventing displacements towards said L-shaped jaws, of said adjusting screw having threaded male portion being rotatably mounted, as to allow strictly rotational displacement without translational displacement of said screw.

15. The bath-chair support as defined in claim 13, wherein said block defines along each of said lateral sides a housing above said plane containing said bottom surface, each of said housings having a rectangular cross-section, said cross-section being parallel to said longitudinal sides, and running substantially from said one of said longitudinal sides to said other of said longitudinal sides, and terminating near said one of said longitudinal sides into a rectangular wall having a circular aperture, and said outwardly projected slide piece of said L-shaped member, being a correspondingly rectangular cross-section, for snugly fitting and sliding inside said housing, said outwardly projected slide piece being substantially perpendicular to said downwardly extending portion defining a jaw, and having fixedly mounted therein a threaded female element, an adjusting screw rotatably mounted about said circular aperture, to said rectangular wall and engaging said threaded female element, for moving said L-shaped member, toward and away from said at least one of said downwardly extending members of the other longitudinal side, said screw operatively connected, being said clamping means, and one downwardly extending member acting as a fixed jaw, being integral with each of said housings, and extending as to be face to face with said downwardly extending portion defining a jaw of said L-shaped member and thereby said block having opposite pairs of fixed jaws and L-shaped members, and retaining outer nut means fixably mounted to one of said opposite ends of said adjusting screw having a threaded male portion and for urging said nut means against said block and thereby acting as said clamping means, and an inner retaining means for preventing displacements towards said L-shaped jaws, of said adjusting screw having threaded male portion being rotatably mounted, as to allow strictly rotational displacement without translational displacement of said screw.

16. The bath-chair support as defined in claim 13, wherein said block defines a symmetrical lateral axis between said lateral sides and a symmetrical longitudinal axis between said longitudinal sides of said block, and said axes meet at the center of said block, and said substantially vertical aperture for sliding therein the shaft of a chair, is extending along said center of said block.

17. The bath-chair support as defined in claim 13, wherein said at least one downwardly extending member acting as a fixed jaw consists in two downwardly extending members:

one along said one of said longitudinal sides near one of said lateral sides, and the other one along said one of said longitudinal sides near the other of said lateral sides, and said block has only one L-shaped member which is positioned midway of said longitudinal side, so as to be midway between said two downwardly extending members.

18. The bath-chair support as defined in claim 13, wherein said downwardly extending members are padded flat bars.

19. The bath-chair support as defined in claim 13, wherein the block is a wood block, the extending members stainless steel flat bars, the slide pieces and the housings hollow square bars.

20. The bath-chair support as defined in claim 13 wherein the block is 3×3×8 inches.

* * * * *